US009502204B2

(12) United States Patent
Ikarashi et al.

(10) Patent No.: US 9,502,204 B2
(45) Date of Patent: Nov. 22, 2016

(54) TRANSMISSION-TYPE X-RAY TARGET AND RADIATION GENERATING TUBE INCLUDING THE SAME

(71) Applicant: CANON KABUSHIKI KAISHA, Tokyo (JP)

(72) Inventors: Yoichi Ikarashi, Fujisawa (JP); Takao Ogura, Yokohama (JP); Takeo Tsukamoto, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 161 days.

(21) Appl. No.: 14/157,403

(22) Filed: Jan. 16, 2014

(65) Prior Publication Data

US 2014/0205071 A1 Jul. 24, 2014

(30) Foreign Application Priority Data

Jan. 18, 2013 (JP) ..... 2013-007454

(51) Int. Cl.
*H01J 35/02* (2006.01)
*H01J 35/08* (2006.01)

(52) U.S. Cl.
CPC ..... *H01J 35/08* (2013.01); *H01J 35/02* (2013.01); *H01J 2235/084* (2013.01); *H01J 2235/087* (2013.01)

(58) Field of Classification Search
USPC ..... 378/143
See application file for complete search history.

(56) References Cited

U.S. PATENT DOCUMENTS

| | | | | |
|---|---|---|---|---|
| 5,148,462 | A * | 9/1992 | Spitsyn | H01J 35/08 378/121 |
| 7,410,839 | B2 * | 8/2008 | Isobe | H01L 27/1214 257/347 |
| 7,713,839 | B2 * | 5/2010 | Hu | H01L 21/76259 148/DIG. 12 |
| 9,070,531 | B2 * | 6/2015 | Ueda | H05G 1/025 |
| 2006/0073640 | A1 | 4/2006 | Hu | |

FOREIGN PATENT DOCUMENTS

| | | | |
|---|---|---|---|
| JP | 2002-298772 | A | 10/2002 |
| JP | 2003-505845 | A | 2/2003 |
| JP | 2009-545840 | A | 12/2009 |
| JP | 2012-256444 | A | 12/2012 |
| WO | 2012140860 | A1 | 10/2012 |

OTHER PUBLICATIONS

Montay et al, "Residual Stress in Coating Technology", J. Mater. Sci. Technol., vol. 20 Suppl. 1 (2004) pp. 81-84.*
Perry et al,"Practical measurement of residual stress in coatings", Surface and Coatings Technology 81 (1996) pp. 17-28.*

* cited by examiner

*Primary Examiner* — Phillip A Johnston
(74) *Attorney, Agent, or Firm* — Canon USA, Inc. IP Division

(57) ABSTRACT

A transmission-type X-ray target includes a flat plate-shaped diamond substrate having a first surface and a second surface facing the first surface and a target layer that is located on the first surface. A residual stress of the first surface is lower than a residual stress of the second surface.

34 Claims, 4 Drawing Sheets

TRANSMISSION-TYPE X-RAY TARGET AND RADIATION GENERATING TUBE INCLUDING THE SAME

BACKGROUND OF THE INVENTION

Field of the Invention

The present invention relates to a radiation generating device that emits X-rays in a wavelength range of 1 pm to 10 nm, which is applicable for medical equipment, a non-destructive inspection apparatus, and the like.

In particular, aspects of the present invention relate to a transmission-type X-ray target including a target layer and a diamond substrate that supports the target layer. Moreover, aspects of the present invention relate to a radiation generating tube including the transmission-type X-ray target, to a radiation generating device including the radiation generating tube, and a radiographic apparatus including the radiation generating device.

Description of the Related Art

In recent years, home care systems have been established and the levels of care provided by emergency medical services have been increased. Accordingly, there is an increasing demand for small and lightweight medical modality apparatuses that are portable. In order to respond to such needs, various medical modality apparatuses have been developed as analysis and diagnostic techniques in the medical field have progressed. Exiting radiographic apparatuses including radiation generating devices are large. Therefore, existing radiographic apparatuses are mainly floor-mounted types used in hospitals and medical examination facilities. To date, such floor-mounted medical modality apparatuses have been used by setting operating periods and non-operating periods, which include maintenance periods.

It is desirable that such radiographic apparatuses including radiation generating devices have high durability and be designed for easy maintenance, so that the operating rate of the apparatus can be increased and the apparatuses can be used as medical modality apparatuses suitable for home-care and emergency medical services in a case of a natural disaster or an accident.

A main factor that determines the durability of a radiation generating device is the durability of a target, which serves as a generation source of radiation, such as X-rays. Typically, a target includes stacked layers. It is known that, in order to increase the durability of a target, it is important to maintain the cohesion of the layers of the target for a long time.

For a radiation generating device that generates radiation by irradiating a target with an electron beam, the radiation generation efficiency of the target is 1% or less. Therefore, almost all of the energy provided to the target is converted into heat. If the heat generated by the target is not sufficiently dissipated to the outside, problems may arise in that the material of the target may degenerate or a problem related to the cohesion, such as separation of a layer due to a stress generated between layers, may occur.

It is known that the radiation generation efficiency can be increased by using a transmission-type X-ray target including a target layer that is a thin film including a heavy metal and a substrate that transmits radiation and that supports the target layer. PCT Japanese Translation Patent Publication No. 2009-545840 describes a rotary-anode-type transmission-type X-ray target having a radiation generation efficiency that his 1.5 times higher than those of existing rotary-anode-type reflection-type targets.

It is known that heat can be efficiently dissipated from the target to the outside by using diamond as the material of a substrate for supporting a target layer of a transmission-type X-ray target. PCT Japanese Translation Patent Publication No. 2003-505845 describes a technology for increasing heat-dissipation performance and realizing a microfocus X-ray device by using diamond as the material of a substrate for supporting a target layer made of tungsten.

Diamond has exceptional characteristics due to strong sp3 bonds and highly regular crystal structure. Among the characteristics of diamond, high heat resistance (melting point of 1600° C. or higher), high thermal conductivity (600-2000 W/m/K), high radiation transmissivity (attributable to being a light element of atomic number 6) are particularly suitable for use as a substrate for supporting a transmission-type X-ray target. In a transmission-type X-ray target according to the present invention, a substrate for supporting a target layer is made of diamond.

However, diamond has low compatibility with a target metal because wettability of a molten metal on diamond is low and the coefficient of linear expansion differs between a solid metal and diamond. Therefore, it may be necessary to improve cohesion between a target layer and diamond substrate in order to improve the reliability of a transmission-type X-ray target.

PCT Japanese Translation Patent Publication No. 2003-505845 describes a transmission-type X-ray target that includes a diamond substrate and that has a stacked structure in which an intermediate layer is disposed between a diamond substrate and a target layer. The intermediate layer serves as a cohesion enhancing layer, although the material of the intermediate layer is not described.

Japanese Patent Laid-Open No. 2002-298772 describes a problem of a radiation generating tube including a transmission-type X-ray target. The problem is that a target layer may become separated from a diamond substrate due to the difference in the coefficient of linear expansion and heat generated when the radiation generating tube is operating. Japanese Patent Laid-Open No. 2002-298772 describes a technology for suppressing separation of the target layer by forming the target layer so as to be convex toward the diamond substrate. Japanese Patent Laid-Open No. 2002-298772 also describes a technology for increasing the reliability of electrical connection between the target layer and an anode member by disposing the target layer so as to extend beyond the periphery of the diamond substrate and overlap the anode member.

However, even with the transmission-type X-ray targets described in PCT Japanese Translation Patent Publication No. 2003-505845 and the Japanese Patent Laid-Open No. 2002-298772, in which cohesion of the target layer and the diamond substrate is improved, variation in radiation output may occur.

SUMMARY OF THE INVENTION

Aspects of the present invention provide a transmission-type X-ray target that suppresses detachment of a fragment of a diamond substrate while maintaining the benefit of using a diamond substrate and that has high reliability in electrical connection between the target layer and the anode member. Aspects of the present invention also provide a radiation generating tube with which variation in output is suppressed and that has high reliability, and a radiation generating device and a radiographic apparatus that include the radiation generating tube.

According to an aspect of the present invention, a transmission-type X-ray target includes a flat plate-shaped diamond substrate having a first surface and a second surface facing the first surface; and a target layer located on the first surface. A residual stress of the first surface is lower than a residual stress of the second surface.

Further features of the present invention will become apparent from the following description of exemplary embodiments with reference to the attached drawings.

DESCRIPTION OF THE EMBODIMENTS

Figure 1A:
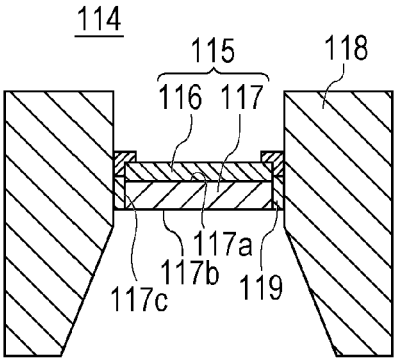
FIGS. 1A, 1B, and 1E are sectional views of a target according to an embodiment of the present invention.

FIGS. 4A to 4F each illustrate a target structure 214 including a transmission-type X-ray target 215. The target 215 includes, at least, a diamond substrate 217 and a target layer 216. The diamond substrate 217 is connected to an anode member 218 through a brazed joint 219 along the periphery thereof.

FIGS. 4A to 4D are each a schematic plan view of the target structure 214 taken along an imaginary plane passing through the target layer 216. FIG. 4E is a sectional view of the target structure 214 taken along line IVE-IVE shown in FIG. 4B. Likewise, FIG. 4F is a sectional view of the target structure 214 taken along line IVF-IVF shown in FIG. 4D.

Figure 4A:
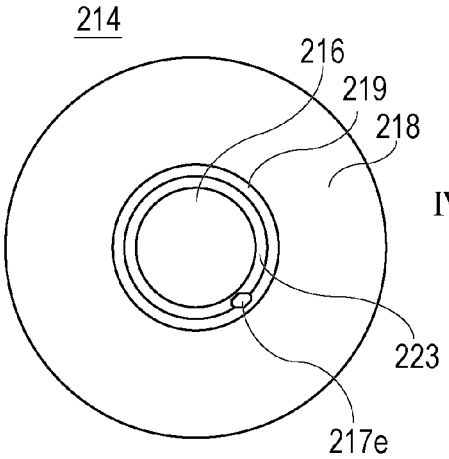
FIGS. 4A to 4D are plan views of a target in which an exposed region was observed.

The target structure 214 illustrated in FIG. 4A includes an annular electrode 223 extending from the periphery of the target layer 216 to the periphery of the diamond substrate 217. The electrode 223 electrically connects the target layer 216 to the anode member 218. The target structure 214 has an exposed region 217*e*, in which the diamond substrate 217 is exposed. The exposed region 217*e* was formed when a fragment of the diamond substrate 217 and a portion of the electrode 223 both became detached from the transmission-type X-ray target.

Figure 4B:
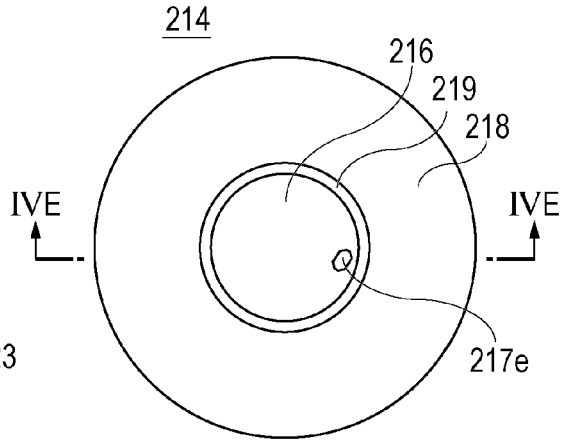
Figure 4C:
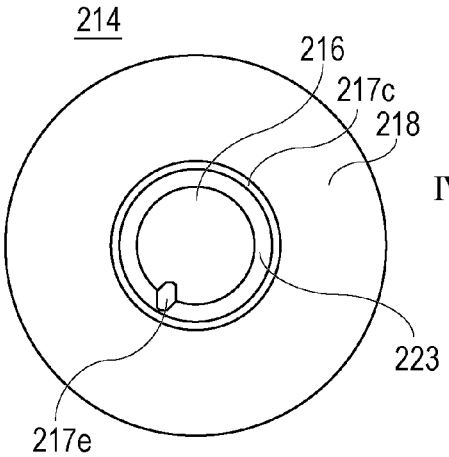
Figure 4D:
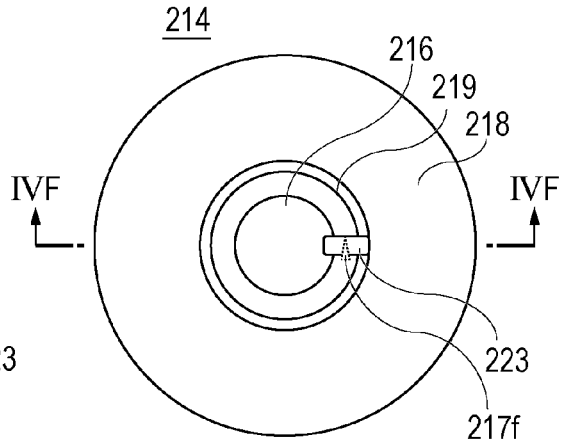
Figure 4E:
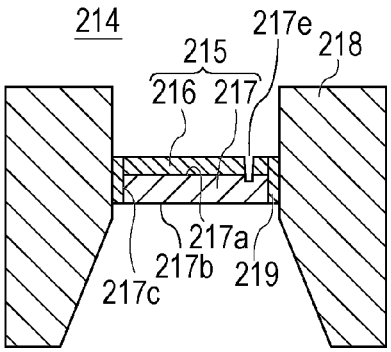
FIGS. 4E and 4F are sectional views of the target.
Figure 4F:
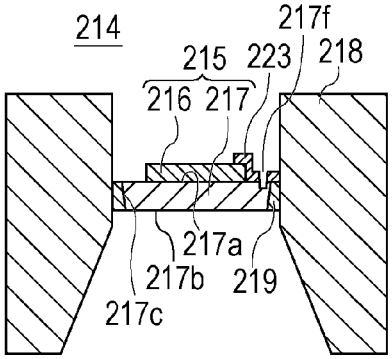

The target structure 214 illustrated in FIGS. 4B and 4F differs from the target structure 214 illustrated in FIG. 4A in that the brazed joint 219 and the target layer 216 are electrically connected to each other without using the electrode 223. The target structure 214 illustrated in FIG. 4B has an exposed region 217*e*, in which the diamond substrate 217 is exposed. The exposed region 217*e* was formed when a fragment of the diamond substrate 217 and a portion of the target layer 216 both became detached from the transmission-type X-ray target 215.

The target structure 214 illustrated in FIG. 4C has the same structure as the target structure 214 illustrated in FIG. 4A. The target structure 214 illustrated in FIG. 4C has an exposed region 217*e*, in which the diamond substrate 217 is exposed. The exposed region 217*e* was formed when a fragment of the diamond substrate 217, a portion of the target layer 216, and a portion of the electrode 223 on both sides of the boundary between the target layer 216 and the electrode 223 became detached from the transmission-type X-ray target 215.

The target structure 214 illustrated in FIG. 4D differs from the target structure 214 illustrated in FIG. 4A in that the brazed joint 219 and the target layer 216 are electrically connected to each other through a strip-shaped electrode 223. The target structure 214 illustrated in FIG. 4D has an exposed region 217*f* severing the strip-shaped electrode 223.

For a radiation generating tube including any one of the target structures 214 illustrated in FIGS. 4A to 4F, variation in tube current correlating to variation in radiation output was observed. Before the target structure 214 illustrated in each of FIGS. 4A to 4F was installed in a radiation generating tube, the target structure 214 did not have an exposed region. Moreover, a transmission-type X-ray target removed from other radiation generating tubes for which variation in output was not observed did not have an exposed region.

In the exposed regions 217*e* and 217*f* in the transmission-type X-ray target illustrated in FIGS. 4A to 4F, typically, a portion of the electrode 223 and a fragment of the diamond substrate or a portion of the target layer 216 and a fragment of the diamond substrate are detached from the transmission-type X-ray target 215. However, in some cases, a fragment of the diamond substrate is not detached, and a portion of the electrode 223 or a portion of the target layer 216 is separated from the diamond substrate 217.

From the examination described above, it is supposed that variation in radiation output occurs because of the following reasons: intermittent occurrence of microdischarge between the exposed regions 217*e* and 217*f* and another member due to concentration of an electric field on a locally exposed insulating surface (the exposed regions 217*e* and 217*f*); and instability in the electric connection between the anode member 218 and the target layer 216 was unstable.

The inventors carried out an intensive study and found that, although the detailed mechanism of occurrence of variation in radiation output is not clear, at least, detachment of a fragment of the diamond substrate 217 at the periphery of the diamond substrate 217 is believed to be related to the mechanism.

A transmission-type X-ray target including a diamond substrate differs from a reflection-type target and a transmission-type X-ray target including a supporting substrate made of beryllium in that it can be difficult to electrically connect a target layer to an anode potential supplying unit from the back side of a radiation emission surface. Therefore, when using a transmission-type X-ray target including a diamond substrate, it may be necessary to provide an electric path to the target layer at the periphery of the diamond substrate.

Detachment of a fragment of the diamond substrate in the transmission-type X-ray target means that an electroconductive foreign matter is generated in the radiation generating tube. Therefore, there is a problem in the reliability of the radiation generating tube in that electroconductive foreign matters may cause discharge and directly decrease the withstand voltage of the radiation generating tube. Also in this respect, it may be necessary to prevent separation of the target layer and the like and detachment of a fragment of the diamond substrate 217 at the periphery of the diamond substrate 217.

Hereinafter, embodiments of the present invention will be described with reference to the drawings.

The material, the shape, the dimensions, and the relative positions of the components describe in the embodiments do not limit the scope of the present invention.

Figure 2A:
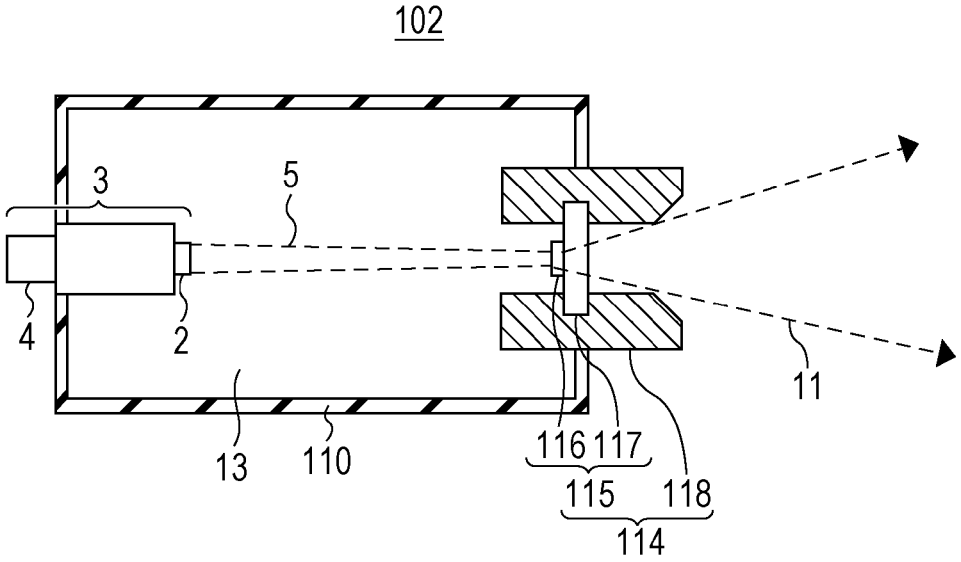
FIG. 2A is a sectional block diagram of a radiation generating tube including the target according to the embodiment of the present invention.
Figure 2B:
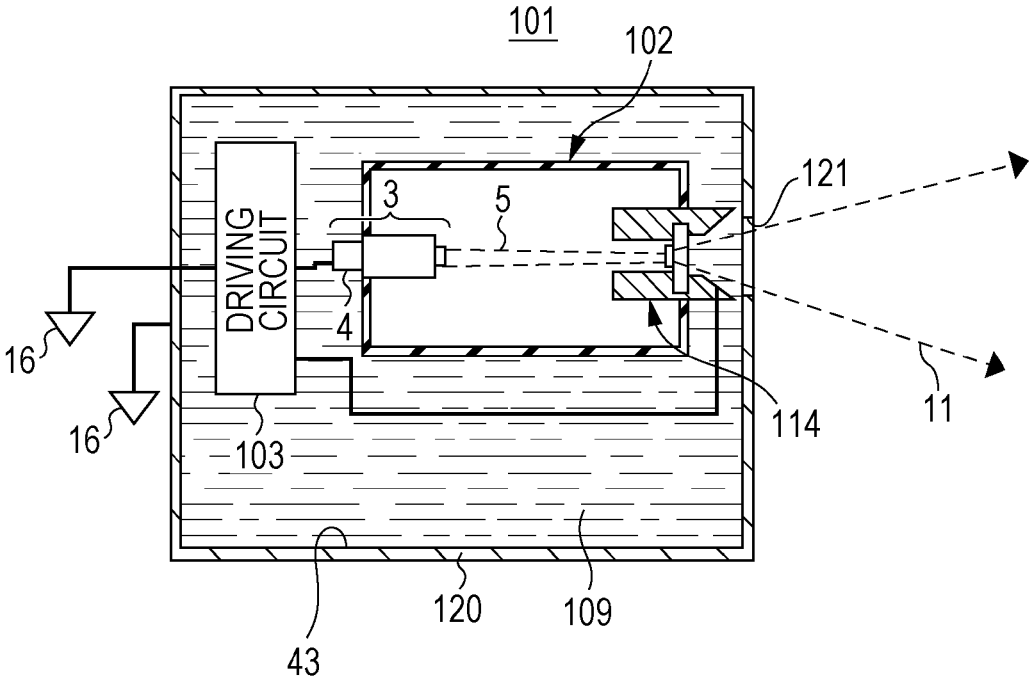
FIG. 2B is a sectional block diagram of a radiation generating device.

FIGS. 2A and 2B are respectively sectional views illustrating a radiation generating tube including a transmission-type X-ray target according to an embodiment of the present invention and a radiation generating device including the radiation generating tube.

Radiation Generating Device

FIG. 2B illustrates a radiation generating device 101 according to an embodiment, which emits a radiation beam 11 from a radiation transmission window 121. The radiation generating device 101 according to the present embodiment includes a container 120 having the radiation transmission window 121, a radiation generating tube 102 that is a radiation source, and a drive circuit 103 for driving the radiation generating tube 102.

The container 120, which contains the radiation generating tube 102 and the drive circuit 103, may have a sufficient strength as a container and high heat dissipation performance. The container 120 may be made of a metal, such as brass, iron, or a stainless steel.

In the present embodiment, an extra space 43 in the container 120 that is not occupied by the radiation generating tube 102 and the drive circuit 103 is filled with an insulating liquid 109. The insulating liquid 109, which is electrically insulating, functions as an electrical insulator in the container 120 and as a coolant for cooling the radiation generating tube 102. The insulating liquid 109 may be an electrically insulating oil, such as a mineral oil, silicone oil, or a perfluoro oil.

Radiation Generating Tube

FIG. 2A illustrates the radiation generating tube 102 according to the embodiment, including an electron emitting source 3 and a transmission-type X-ray target 115 facing the electron emitting source 3. (Hereinafter, the transmission-type X-ray target will be simply referred to as a target.)

In the present embodiment, the radiation beam 11 is generated by irradiating a target layer 116 of the target 115 with an electron beam 5 emitted from an electron emitting unit 2 of the electron emitting source 3. Electrons in the electron beam 5 are accelerated by an electric field formed between the electron emitting source 3 and the target layer 116 so as to have an incident energy required for generating radiation. Such an acceleration electric field is generated in an inner space 13 of the radiation generating tube 102 as a tube voltage Va, which is output from the drive circuit 103, provides a cathode potential to the electron emitting source 3 and an anode potential to the target layer 116.

A target structure 114 includes the target 115 and an anode member 118. The target 115 includes the target layer 116 and a diamond substrate 117, which supports the target layer 116.

The target layer 116 can be made to emit radiation having a desired frequency by selecting a target material included in the target layer 116, the thickness of the target layer 116, and the tube voltage Va.

The target material may include a metal having an atomic number that is 40 or higher, such as Mo (molybdenum), Ta (tantalum), or W (tungsten). The target layer 116 may be formed on the diamond substrate 117 by using any film-forming method, such as vapor deposition or sputtering. In order to achieve high cohesion between the target layer 116 and the diamond substrate 117, PCT Japanese Translation Patent Publication No. 2003-505845 describes a structure including an intermediate layer (not shown) disposed between the target layer 116 and the diamond substrate 117. Such a structure is also within the scope of the present invention.

The layer thickness of the target layer 116 may be in the range of 1 μm to 20 μm. With consideration of ensuring a sufficient intensity in radiation output and reducing an interfacial stress, the layer thickness may be in the range of 2 μm to 10 μm.

Figure 1B:
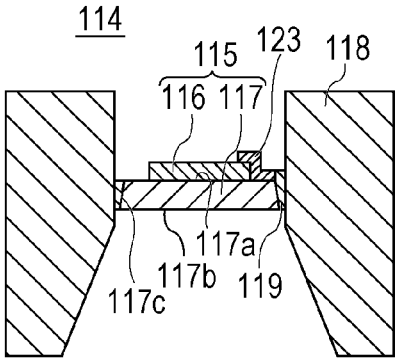
Figure 1C:
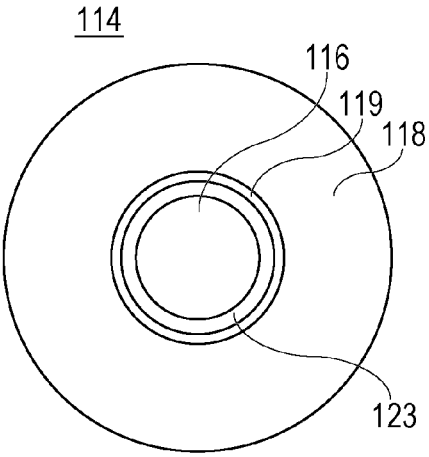
FIGS. 1C and 1D are plan views of the target.
Figure 1D:
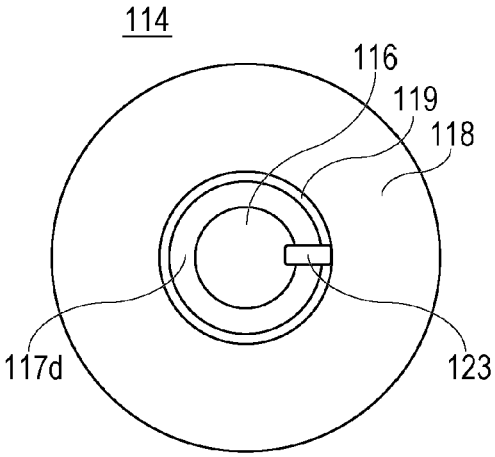
Figure 1E:
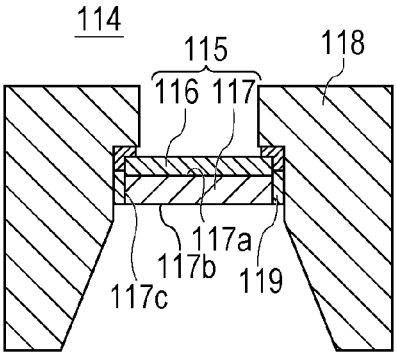

The anode member 118 at least has a function of determining an anode potential of the target layer 116. As illustrated in FIG. 1E, the anode member 118 is located along the periphery of a first surface 117*a* of the diamond substrate 117. Alternatively, as illustrated in FIGS. 1A and 1B, the anode member 118 is located along a side surface 117*c* of the diamond substrate 117. When the anode member 118 is disposed and connected as illustrated in any one of FIGS. 1A, 1B, and 1E, the anode member 118 also has the function of holding the target 115 and the function of determining the angle at which radiation is emitted (radiation angle) in a desired direction.

By making the anode member 118 from a high specific-gravity material, the anode member 118 can have a radiation blocking function. The anode member 118 may be made of a material for which the product of the mass absorption coefficient $\mu/\rho$ [$m^2/kg$] and the density [$kg/m^3$] is large, because, in this case, the sizes of the anode member 118 and the target structure 114 can be reduced.

The anode member 118 may be made of an appropriate metallic element having intrinsic absorption edge energy in accordance with characteristic X-ray energy of radiation generated by the target layer 116, because, in this case, the sizes of the anode member 118 and the target structure 114 can be further reduced. The anode member 118 may include copper, silver, Mo, Ta, W, and the like. The anode member 118 may include metallic elements the same as those of the target metal included in the target layer 116.

In the present embodiment, the anode member 118 has a cylindrical shape surrounding the target 115. Therefore, the anode member 118 functions as a front blocking member that limits the range of emission angle of radiation emitted from the target layer 116. In the present embodiment, the anode member 118 also functions as a rear blocking member that limits the region that reflected electrons (not shown) and backscattered radiation (not shown) reach. Such reflected electrons are backscattered from the target layer 116 in the direction toward the electron emitting source 3.

The radiation generating tube 102 includes an insulating pipe 110 as a barrel portion. The insulating pipe 110 electrically insulates the electron emitting source 3 having a cathode potential and the target layer 116 having an anode potential from each other. The insulating pipe 110 is made of an insulating material, such as a glass or a ceramic. The insulating pipe 110 may have a function of determining the distance between the electron emitting source 3 and the target layer 116.

The inner space 13 in the radiation generating tube 102 is decompressed so that the electron emitting source 3 can function. The degree of vacuum of the inner space 13 in the radiation generating tube 102 may be in the range of $10^{-8}$ Pa to $10^{-4}$ Pa. With consideration of the lifetime of the electron emitting source 3, the degree of vacuum may be in the range of $10^{-8}$ Pa to $10^{-6}$ Pa.

As a vacuum vessel, the radiation generating tube 102 may have a hermeticity and a pressure-resistance with which such a degree of vacuum can be maintained. The inside of the radiation generating tube 102 may be decompressed by sucking air through a discharge pipe (not shown) by using a vacuum pump (not shown) and then sealing the discharge pipe. A getter (not shown) may be disposed in the radiation generating tube 102 in order to maintain the degree of vacuum.

In the present embodiment, the diamond substrate 117 functions as a transmission window through which radiation generated by the target layer 116 is emitted toward the outside of the radiation generating tube 102 and also functions as a part of the vacuum vessel.

The electron emitting source 3 is disposed so as to face the target layer 116 of the target 115. As the electron emitting source 3, for example, a hot cathode, such as a tungsten filament or an impregnated cathode, or a cold cathode, such as a carbon nanotube, may be used. The electron emitting source 3 may include a grid electrode (not shown) or an electrostatic lens electrode so that the beam diameter of the electron beam 5, the density of electron current, and on-off control can be performed.

Target

Next, referring to FIG. 1, the target 115 (transmission-type X-ray target) according to an embodiment of the present invention will be described in detail.

FIGS. 1A and 1B illustrate the target structure 114 in which the target 115 and the anode member 118 are joined to each other through a brazed joint 119. The target 115 includes the target layer 116, which is formed on the first surface 117*a* of the diamond substrate 117. FIGS. 1C and 1D are plan views respectively illustrating the target structures 114 illustrated in FIGS. 1A and 1B, seen from a side on which the target layer 116 is formed. FIG. 1E illustrates a modification of the target structure 114 illustrated in FIG. 1A, in which the anode member 118 and the target 115 are electrically connected to each other on a side on which the target layer 116 is formed.

The diamond substrate 117 may be made from a natural diamond or a synthetic diamond. In consideration of reproducibility, uniformess, and the cost, a synthetic diamond made by using a high-pressure high-temperature method or a chemical vapor deposition method may be used. In particular, a synthetic diamond made by using a high-pressure high-temperature method may be used, because a uniform crystal structure can be obtained by using the method.

As illustrated in FIGS. 1A, 1B, and 1E, the diamond substrate 117 may have a flat plate-like shape having a first surface and a second surface facing the first surface. For example, the diamond substrate 117 may have a rectangular parallelepiped shape or a disk-like shape.

When the diamond substrate 117 has a disk-like shape having a diameter in the range of 2 mm to 10 mm, it is possible to dispose the target layer 116 that is capable of forming an appropriate focal diameter on the diamond substrate 117. When the diamond substrate 117 has a disk-like shape having a thickness in the range of 0.5 to 4.0 mm, the diamond substrate has an appropriate radiation transmissivity. When the diamond substrate 117 has a rectangular parallelepiped shape, each of the short side and the long side of the rectangular parallelepiped shape may have a length in the range described above.

The diamond substrate 117 has the side surface 117*c*. The side surface 117*c* is a cylindrical surface through which the periphery of the first surface 117*a* is connected to the periphery of a second surface 117*b*.

In consideration of the radiation transmissivity, the aspect ratio (thickness/diameter) of the diamond substrate 117 may be lower than 1. Therefore, it is economical to make the diamond substrate 117 having an appropriate aspect ratio by separating a part of a plate-shaped base material that has an appropriate thickness and that has a principal surface perpendicular to the thickness direction.

This method has an advantage in production for either of a case where a diamond made by using a high-pressure high-temperature method is used or a case where a diamond made by using a chemical vapor deposition method is used. In the former case, because the diamond substrate is cut from a base material having a smaller dimension in the thickness dimension with consideration of the crystal structure of the diamond substrate, there is an advantage in that the influence of the crystal orientation of the base material can be suppressed during the cutting process. Such an influence of the crystal orientation includes cleavage. In the latter case, this film-forming method is suitable for forming a base material having a dimension in the in-plane direction larger than that in the thickness direction.

A high-pressure synthesized diamond substrate has a single-crystal structure, and a predetermined crystal orientation can be allocated for a principal surface. The surface tension of a solid crystal depends on the crystal orientation of the surface. Therefore, by using a high-pressure synthetic diamond for the diamond substrate 117, an appropriate crystal orientation can be allocated for the first surface 117*a*, on which the target layer 116 is formed. For example, by using a (100) surface as the first surface 117*a*, cohesion between the target layer 116 and the diamond substrate 117 can be increased.

At least the target layer 116 is formed on the first surface 117*a* of the diamond substrate 117. Therefore, the first surface 117*a* need to have precision in the shape and detergency performance that are higher than those of other surfaces of the diamond substrate 117. When a method of separating the diamond substrate 117 from a plate-shaped diamond base material (not shown) is used, it is possible to smooth down the entirety of a principal surface of the plate-shaped base material before separating the diamond substrate from the base material. With this method, diamond substrates 117 each having the first surface 117*a* having high precision and high reproducibility can be manufactured.

The diamond substrate 117 may be separated from the base material by various methods, for example, mechanical polishing, etching, local heating light irradiation, focused ion beam irradiation, and the like. In order to prevent damage to a surface (for example, the first surface 117*a*) of the diamond substrate 117 other than the side surface, local heating light irradiation or focused ion beam irradiation are appropriate methods. In particular, local heating light irradiation using a laser light source is particularly appropriate, because it is not necessary to perform atmosphere control and ions are not implanted into the diamond substrate.

The reason why the exposed regions 217*e* and 217*f* were formed in the target structures 214 illustrated in FIG. 4 will be described below.

The inventors carried out an intensive study and found that there was a correlation between the distribution of generation of the exposed regions 217*e* and 217*f* and the distribution of measured residual stress, and that generation of exposed regions 217*e* and 217*f* occurred due to the difference between surfaces in the amount of residual stress remaining in the diamond substrate when the target layer was formed.

Although the exact reason why the residual stress remaining in the diamond substrate differs between the surfaces was not clear, one of the estimated reasons was the anisotropy of a cutting process when cutting a diamond substrate from a base material. Another estimated reason was the influence of a shape formed by the opposing surfaces and the side surface of a diamond substrate.

For example, in a diamond substrate separated from a base material by laser processing, a surface having a region in which the residual stress was relatively high was a surface opposite to a surface on which the laser beam was incident.

In a diamond substrate separated from a base material by machining, there was a correlation between the direction in which a cutter of a cutting machine entered into the diamond substrate and the residual stress, and a surface from which the cutter exits the diamond substrate had a high residual stress.

Next, the shape formed by the opposing surfaces and the side surface of the diamond substrate will be described in detail. It was found that the residual stress depended also on the shape of end surfaces of the diamond substrate 117 and was related to generation of cracks and detachment of a fragment of diamond from the surface on which the target layer 216 is formed. To be specific, it was found that, in a case where the angle between the side surface and the principal surface is an acute angle, the residual stress remaining in the principal surface was larger than in a case where the angle was an obtuse angle. In the present specification, the angle between the principal surface and the side surface is an interior angle of a cross-sectional shape of the diamond substrate.

As illustrated in FIG. 1A, according to a first embodiment of the present invention, the target layer 116 is formed on the first surface 117*a* of the diamond substrate 117, which has a lower residual stress. Thus, generation of a crack in the diamond substrate 117, detachment of the target layer 116, and separation of an electrode 123 are suppressed.

As illustrated in FIG. 1B, according to a second embodiment of the present invention, the angle between the first surface 117*a* and the side surface 117*c* is larger than the angle between the second surface 117*b*, which faces the first surface 117*a*, and the side surface 117*c*. The target layer 116 is disposed on the first surface 117*a*.

In the second embodiment, as illustrated in FIG. 1B, the angle between the first surface 117*a* and the side surface 117*c* may be an obtuse angle.

When the diamond substrate 117 has both of the features of the first embodiment and the second embodiment, the residual stress of the diamond substrate 117 can be reliably reduced and the target 115 having a higher reliability can be obtained.

As described above, in the case where a distribution of residual stress exists on each of the first surface 117*a* and the second surface 117*b* of the diamond substrate 117, one of the surfaces having a maximum residual stress that is lower than that of the other surface will be referred to as a lower-residual-stress surface.

The first surface 117*a* of the diamond substrate 117, which is a lower-residual-stress surface, can be identified by using a birefringence method or laser Raman spectroscopy. In the present invention, other methods for measuring residual stress may be used.

When a crystal structure a substance is changed due to a stress, birefringence occurs that causes anisotropy in refractive index that is dependent on the oscillation direction of light passing through the substance. At this time, because the light passed through the substance has a phase difference that is dependent on the oscillation direction of the light, it is possible to identify the stress by performing an optical observation. Such a stress that can be identified by using a birefringence phase difference will be referred to as a photoelastic stress. Therefore, by detecting the birefringence phase difference between an incident beam and a transmission beam passed through the diamond substrate, it is possible to identify a position at which a stress is generated. A first method for identifying a low-residual-stress surface is the birefringence phase difference method of measuring the photoelastic stress.

Laser Raman spectroscopy is a method of detecting a change in the wavelength of Raman scattering light that is generated due to the crystal structure or molecular vibrations of a substance when the substance is irradiated with a laser beam. This method is generally used for identifying the substance, because the crystal structure and molecular vibrations are specific to the substance. However, this method can be also used to measure the distribution of stress, because the crystal structure, such as the bond length and the bond angle of atoms, changes due to the presence of a stress and accordingly the wavelength of scattered light changes. By detecting the change in the wavelength by laser Raman spectroscopy, it is possible to measure the distribution of residual stress in the diamond substrate 117. A second method for identifying the low-residual-stress surface is laser Raman spectroscopy of detecting a change in the wavelength of Raman scattering light.

When a low tenacity member has a residual stress, a microcrack having a width in the range of about 0.1 to 100 μm may be generated due to the residual stress. It is expected that, when a microcrack is generated, the stress may be released from the diamond substrate. However, as a result of examination performed by the inventors and others, a birefringence phase difference was observed in a microcrack region or in the vicinity of the microcrack region. Therefore, the inventors found that a stress generated during processing was not sufficiently released from the diamond substrate due to generation of a microcrack and remained in the vicinity of the microcrack, and the residual stress further caused a microcrack or detachment of a fragment of the diamond substrate.

A third method for identifying a low-residual-stress surface is evaluating the distribution of microcracks in a diamond substrate by observing the diamond substrate with a microscope. By using the third method for identifying a low-residual-stress surface, it is possible to indirectly identify a low-residual-stress surface. Any microscope that can be used to observe the surface profile of the diamond substrate 117 can be used. Examples of such microscopes include an optical microscope, a scanning electron microscope (SEM, STM, or TEM), and an atomic force microscope (AFM).

A fourth method for identifying a low-residual-stress surface is a microscopic observation of identifying the shape of an end portion of the diamond substrate. The inventors found that there was a correlation between the distribution of residual stress in the diamond substrate 117 and the angle between the side surface 117*c* and the first surface 117*a* (principal surface) or the second surface 117*b* (principal surface). To be specific, the two principal surfaces faced each other with the side surface 117*c* therebetween, and when the angle between the first surface 117*a* and the side surface 117*c* was larger than the angle between the second surface 117*b* and the side surface 117*c*, it was possible to identify that the first surface 117*a* was a low-residual-stress surface having a residual surface lower than that of the second surface 117*b*.

As illustrated in FIG. 1A, the target layer 116 may be formed on the entirety of the first surface 117*a* of the diamond substrate 117 having a lower residual stress. Alternatively, as illustrated in FIG. 1B, the target layer 116 may be formed on a part of the first surface 117*a* of the diamond substrate 117 separated from the periphery (end portion) of the diamond substrate 117.

In the embodiment illustrated in FIG. 1B, in order to electrically connect the target layer 116 and the anode member 118 to each other, the electrode 123 made of a conductive material is formed between the periphery of the target layer 116 and the periphery of the diamond substrate 117.

The electrode 123 in the present embodiment, which is in direct contact with the diamond substrate 117, may include a metal having a negative standard free energy of formation of carbide in view of cohesion with the diamond substrate. Examples of a metal having a negative standard free energy of formation of carbide include titanium, zirconium, and chromium. The electrode 123 may have a film thickness in the range of 100 nm to 10 μm because such a film provides both good electrical connection and high cohesion.

In the embodiment illustrated in FIG. 1A, the target layer 116 is formed so as to extend to the periphery of the diamond substrate 117, and the electrode 123 is disposed along the periphery of the diamond substrate 117. In the present embodiment, the electrode 123 provides electrical connection and prevents interdiffusion between the brazed joint 119 and the target layer. In the present embodiment, the electrode 123 is formed on the target layer 116. Alternatively, the electrode 123 may be formed between the target layer 116 and the diamond substrate 117.

The brazed joint 119 may be appropriately selected on the basis of the operating temperature of the radiation generating tube 102 and adhesion to an object to be joined. Specific examples of the brazed joint 119 include a Cr—V-based alloy, a Ti—Ta—Mo-based alloy, a Ti—V—Cr—Al-based alloy, a Ti—Cr-based alloy, a Ti—Zr—Be-based alloy, a Zr—Nb—Be-based alloy, an alloy including Au—Cu as a main component, nickel solder, brass solder, and silver solder.

With the target 115 according to the embodiments described above, fragments of diamond having a conductive substance thereon is prevented from being scattered in the radiation generating tube 102 and therefore discharge in the radiation generating tube 102 can be suppressed. Moreover, it is possible to prevent a loose electrical connection between the target layer 116 and the drive circuit 103 due to cracks in the diamond substrate and detachment of a portion of the diamond substrate. Thus, a radiation generating device having a high reliability can be provided.

Radiation Imaging Apparatus

Next, referring to FIG. 3, the structure of a radiographic apparatus including a target according to an embodiment of the present invention will be described.

A system control unit 202 integrally controls the radiation generating device 101 and a radiation detector 206. Under the control by the system control unit 202, the drive circuit 103 outputs various control signals to the radiation generating tube 102. In the present embodiment, the drive circuit 103 and the radiation generating tube 102 are disposed in the container 120 of the radiation generating device 101. Alternatively, the drive circuit 103 may be disposed outside of the container 120. On the basis of the control signals output from the drive circuit 103, emission of the radiation beam 11 from the radiation generating device 101 is controlled.

A system control unit 202 integrally controls the radiation generating device 101 and a radiation detector 206. Under the control by the system control unit 202, the drive circuit 103 outputs various control signals to the radiation generating tube 102. In the present embodiment, the drive circuit 103 and the radiation generating tube 102 are disposed in the container 120 of the radiation generating device 101. Alternatively, the drive circuit 103 may be disposed outside of the container 120. On the basis of the control signals output from the drive circuit 103, emission of the radiation beam 11 from the radiation generating device 101 is controlled.

Under the control by the system control unit 202, the signal processor 205 performs predetermined signal processing on the image signal, and outputs the processed image signal to the system control unit 202.

The system control unit 202 outputs a display signal, for causing a display apparatus 203 to display an image, to the display apparatus 203.

The display apparatus 203 displays an image based on the display signal on a screen as an image of the object 204.

Typically, radiation relating to the embodiments of the present invention is X-rays. The radiation generating device 101 and the radiographic apparatus according to the embodiments of the present invention can be respectively used as an X-ray generation unit and an X-ray imaging system. The X-ray imaging system can be used for non-destructive testing of industrial products and diagnosis of human bodies and animals.

EXAMPLES

Example 1

The target structure 114 illustrated in FIGS. 1A and 1C was made through the following process.

The diamond substrate 117 was separated, by using a laser beam, from a plate-shaped base material, which was made of a single-crystal diamond made by using a high-pressure high-temperature method. The diamond substrate 117 had a disk-like shape having a thickness of 1 mm and a diameter of 5 mm.

The residual stress of the diamond substrate 117 was measured by using a commercially-available birefringence measuring apparatus, and thereby the first surface 117*a* having a lower residual stress in an end portion of the diamond substrate 117 was identified. In addition, the presence of microcracks was observed by using a scanning electron microscope and an optical microscope. In the surface having a lower residual stress, microcracks were not present. In Example 1, the number of microcracks having a width of 1 μm or larger was counted.

Next, a tungsten film having a thickness 5 μm was formed as the target layer 116 on the entirety of the first surface 117*a* of the diamond substrate 117 having a lower residual stress. The target layer 116 was formed by using a sputtering method using argon as a carrier gas.

Next, the annular electrode 123 made of titanium was formed by using a sputtering method so as to extend inward from the periphery of the target structure, including the diamond substrate 117 and the target layer 116, with a width of 100 μm.

Next, the side surface 117*c* of the diamond substrate 117 and an inner wall of the anode member 118 having a tubular shape were joined to each other through the brazed joint 119 made of silver solder. In this step, brazing was performed so that a part of the brazed joint 119 was in contact with at least the electrode 123. The material of the anode member 118 was tungsten.

The target structure 114, which had been made as described above, was mounted in the radiation generating tube 102 illustrated in FIG. 2A, and the radiation generating device 101 illustrated in FIG. 2B was made. Next, the radiation generating device 101 was operated and the stability of output operation and the variation in radiation output were evaluated. As a result, discharge in the radiation generating tube 102 was not observed and it was confirmed that the radiation generating device 101 could operate stably. Moreover, variation in radiation output was measured, and significant variation in output was not observed. That is, in the radiation generating device 101 according to Example 1, a fault due to a loose electrical connection between the target layer 116 and the anode member 118 did not occur.

In Example 1, detection of discharge was performed by connecting a discharge counter (not shown) to four portions of the radiation generating device 101, including the anode member 118, the current input terminal 4, a connection line connecting a ground terminal 16 to the drive circuit 103, and a connection line connecting the container 120 to the ground terminal 16.

In Example 1, variation in radiation output was evaluated as follows. A dosimeter (not shown) was placed at a position that is distanced by 100 cm from the diamond substrate 117 toward the outside of the container 120 along an extension line of a line connecting the electron emitting unit 2 to the center of the target layer 116. The dosimeter included a semiconductor detector and was capable of detecting sequential variation in the intensity of the radiation beam 11.

Variation in the radiation output was measured by causing the drive circuit 103 to drive the electron emitting source 3 for a three-second interval in every thirty-second periods and by measuring sequential variation in the radiation output in a two-second interval at the middle of the three-second interval. The conditions of counting the variation in the radiation were such that an occurrence of variation that was 2% or more of the average intensity of radiation output in the two-second interval was counted as a significant variation in radiation output. During the evaluation of variation in radiation output, a tube current flowing from the target layer 116 to the ground terminal 16 was controlled by using a negative feedback circuit (not shown) having a detector (not shown) so that the variation in the tube current was limited to 1% or less.

Figure 3:
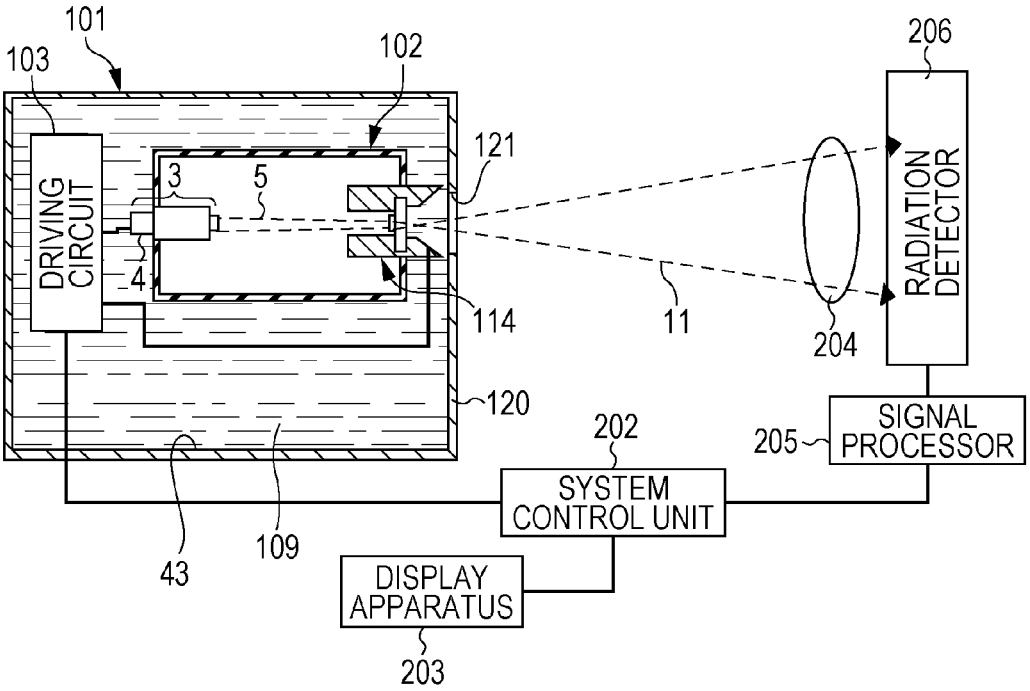
FIG. 3 is a block diagram of a radiographic apparatus including the radiation generating device according to the embodiment of the present invention.

Moreover, a radiographic apparatus 60 including the radiation generating device 101 according to Example 1 was made as illustrated in FIG. 3, and a test operation of the radiographic apparatus 60 was performed. As a result, radiographic imaging was stably performed. In the test operation and radiographic imaging, the tube voltage Va was set to be 110 kV.

Next, the target structure 114 was removed from the radiation generating tube 102, and the target structure 114 was observed. An exposed region was not found in the target 115.

Comparative Example 1

With existing technologies, a target layer is formed on a diamond substrate without identifying a residual stress in an end portion of the diamond substrate, and therefore a target layer may be formed on a surface having a higher residual stress. In order to perform comparison with embodiments of the present invention, in Comparative Example 1, a target layer was formed on a surface of a diamond substrate having a higher residual stress in an end portion of the diamond substrate.

A diamond substrate having the same shape as that of Example 1 was used. A surface having a higher residual stress was identified by using a birefringence measuring apparatus. In addition, the presence of microcracks was observed by using an electron microscope and an optical microscope. In the surface having a higher residual stress, three microcracks were found. The number of microcracks was counted in the same way as in Example 1.

Next, the target layer 216 and the electrode 223 were formed as in Example 1 on the surface of the diamond substrate having a higher residual stress. Then, the target structure 214 was made by joining the electrode 223 and the anode member 218 to each other through the brazed joint 219. The target structure 214 was mounted in a radiation generating tube, and a radiation generating device was made by and installing the radiation generating tube and a drive circuit, which was electrically connected the radiation generating tube, in a container. Subsequently, a test operation was performed in the same way as in Example 1.

In Comparative Example 1, during a one-hour evaluation time, it was possible to continuously apply a tube voltage. However, variation in radiation output was observed twice during the evaluation time. It was estimated that this variation occurred due to a microdischarge.

Next, the target structure 214 was removed from the radiation generating tube used in Comparative Example 1, and the target structure 214 was observed by using an optical microscope. An exposed region 217*e* illustrated in FIG. 4A was found in a region in which the electrode 223 was formed.

Example 2

The target structure 114 illustrated in FIGS. 1B and 1D was made through the following process.

As in Example 1, the diamond substrate 117 was cut, by irradiating a laser beam, from a base material, which was made of a single-crystal diamond. The diamond substrate 117 was measured by using an optical microscope. The angle between the first surface 117*a* and the side surface 117*c* was 93.2 degrees, and the angle between the second surface 117*b* and the side surface 117*c* was 86.8 degrees.

As in Example 1, the first surface 117*a* having a lower residual stress was identified by using a birefringence method. The first surface 117*a* was observed by using an electron microscope and an optical microscope. As a result, microcracks were not observed in the first surface 117*a* of the diamond substrate 117 having a lower residual stress. The angle between the first surface 117*a* and the side surface 117*c* was 93.2 degrees, which was the same as above.

Next, a tungsten film having a thickness of 6 μm was formed as the target layer 116. The target layer 116 was formed on a circular portion having a diameter of ϕ2 mm of the first surface 117*a* of the diamond substrate 117 having a lower residual stress. As in Example 1, the target layer 116 was formed by using a sputtering method using argon as a carrier gas.

Next, in order to electrically connect the target layer 116 and the anode member 118 to each other, the electrode 123, which was a strip having a width of 100 μm and including a copper titanium alloy, was formed so as to extend from the periphery of the target layer 116 to the periphery of the diamond substrate 117. The electrode 123 was formed so as to overlap the target layer 116 with a width of 50 μm. The electrode 123 was formed from a paste having a metallic content by using a screen printing method and a burning method.

The side surface 117*c* of the diamond substrate 117 and the anode member 118 was joined to each other through the brazed joint 119 made of silver solder. Brazing was performed so that a part of the brazed joint 119 contacts the electrode 123. As in Example 1, the material of the anode member 118 was tungsten.

As in Example 1, the radiation generating device 101 illustrated in FIG. 2B was made by mounting the target structure 114, which has been made as described above, in the radiation generating tube 102 illustrated in FIG. 2A. Then, the radiation generating device 101 was operated and the stability of radiation output was examined.

Also in Example 2, discharge in the radiation generating tube 102 was not observed and it was confirmed that the radiation generating device 101 was operated stably. Moreover, variation in radiation output was measured, and significant variation in output was not observed. That is, also in the radiation generating device 101 according to Example 1, a fault due to a loose electrical connection between the target layer 116 and the anode member 118 did not occur.

Moreover, the radiographic apparatus 60 including the radiation generating device 101 according to Example 2 was made as illustrated in FIG. 3, and a test operation of the radiographic apparatus 60 was performed. As a result, radiographic imaging was stably performed. In the test operation and radiographic imaging, the tube voltage Va was set to be 110 kV.

Next, the target structure 114 was removed from the radiation generating tube 102, and the target structure 114 was observed. An exposed region was not found in the target 115.

Comparative Example 2

A diamond substrate having the same shape as that of Example 2 was used. A surface having a higher residual stress was identified by using a birefringence measuring apparatus. In addition, the presence of microcracks was observed by using an electron microscope and an optical microscope. In a surface having a higher residual stress, three microcracks were found. The number of microcracks was counted in the same way as in Example 1.

Next, the target layer 216 and the electrode 223 were formed as in Example 1 on the surface of the diamond substrate having a higher residual stress. Then, the target structure 214 was made by joining the electrode 223 and the anode member 218 to each other through the brazed joint 219. The target structure 214 was mounted in a radiation generating tube, and a radiation generating device was made by and installing the radiation generating tube and a drive circuit, which was electrically connected the radiation generating tube, in a container. Subsequently, a test operation was performed in the same way as in Example 2.

In Comparative Example 2, during a one-hour evaluation time, it was possible to continuously apply a tube voltage. However, variation in output, which was estimated to have occurred due to microdischarge, was observed four times during the evaluation time.

Next, the target structure 214 was removed from the radiation generating tube used in Comparative Example 2, and the target structure 214 was observed by using an optical microscope. An exposed region 217*f* illustrated in FIGS. 4D and 4F was found in a region in which the electrode 223 was formed. The exposed region 217*f* was observed in detail by using a scanning electron microscope. As a result, an exposed region in which the electrode 223 was separated from the diamond substrate 217 and an exposed region in which the electrode 223 and a fragment of the diamond substrate were both detached from the target 215 were found.

It is estimated that the former exposed region was secondarily generated after both a fragment of the diamond substrate and the electrode 223 had been detached.

In each of Examples 1 and 2 and Comparative Examples 1 and 2, before the targets 115 and 215 were mounted in the radiation generating tube, detachment of a fragment of the diamond substrate was not observed in both of the targets 115 and 215. It is estimated that, in Comparative Examples 1 and 2, the exposed regions 217*e* and 217*f*, which were found after the target 215 was removed from the radiation generating tube, occurred due to the following mechanism.

In addition to a residual stress of the surface of the diamond substrate on which the target layer 216 was formed, a tensile stress was applied to the surface. The tensile stress was generated as the target layer or the electrode expanded due to an increase in the temperature of the radiation generating tube (coefficient of linear expansion ratio $\alpha$ tungsten/$\alpha$ diamond=4.5>1). As a result, microcracks were generated and developed in the diamond substrate, leading to detachment of the diamond substrate.

With the present invention, a transmission-type X-ray target having a high reliability can be provided. With the transmission-type X-ray target, detachment of a fragment of the diamond substrate from a target is prevented. Moreover, a radiation generating tube having a high reliability can be provided. With the radiation generating tube, variation in radiation output is suppressed and scattering of diamond fragments, to which a conductive substance adheres, in the radiation generating tube can be prevented. Furthermore, a radiation generating device and a radiographic apparatus including a radiation generating tube having a high reliability can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-007454, filed Jan. 18, 2013, which is hereby incorporated by reference herein in its entirety.

What is claimed is:

1. A transmission-type X-ray target comprising:

a flat plate-shaped diamond substrate having a first surface, a second surface opposing the first surface, and a side surface between the first and second surface; and a target layer located on the first surface, wherein an angle between the first surface and the side surface and an angle between the second surface and the side surface are so configured such that a residual stress of the first surface is lower than a residual stress of the second surface.

2. The transmission-type X-ray target according to claim 1, wherein, in a case where a distribution of residual stress exists on each of the first surface and the second surface, the residual stress of the first surface is lower than the residual stress of the second surface if and only if a maximum residual stress of the first surface is lower than a maximum residual stress of the second surface.

3. The transmission-type X-ray target according to claim 1, wherein the diamond substrate further has a side surface, and wherein an angle between the first surface and the side surface is larger than an angle between the second surface and the side surface.

4. The transmission-type X-ray target according to claim 1, wherein the angle between the first surface and the side surface is an obtuse angle.

5. The transmission-type X-ray target according to claim 1, wherein the diamond substrate is a single-crystal diamond.

6. The transmission-type X-ray target according to claim 5, wherein the diamond substrate is made by separating a part of a base material, which is made of a single-crystal, from the base material.

7. The transmission-type X-ray target according to claim 6, wherein the diamond substrate is made by separating a part of the base material from the base material by irradiation of local heating light.

8. The transmission-type X-ray target according to claim 1, wherein a layer thickness of the target layer is in the range of 1 μm to 20 μm.

9. The transmission-type X-ray target according to claim 1, further comprising:

an electrode disposed on the diamond substrate so as to extend from a periphery of the target layer to a periphery of the diamond substrate, the periphery of the target layer being distant from the periphery of the diamond substrate.

10. The transmission-type X-ray target according to claim 9, wherein the electrode includes a metallic element having a negative standard free energy of formation of carbide.

11. The transmission-type X-ray target according to claim 10, wherein the electrode includes titanium, zirconium, or chromium.

12. The transmission-type X-ray target according to claim 9, wherein a layer thickness of the electrode is in the range of 100 nm to 10 μm.

13. A target structure comprising:

the transmission-type X-ray target according to claim 3; and an anode member that is located along at least one of the side surface and a periphery of the first surface and that is electrically connected to the target layer.

14. The target structure according to claim 13, wherein the target layer and the anode member are electrically connected to each other through a brazed joint.

15. A radiation generating tube comprising:

the transmission-type X-ray target according to claim 1;

an electron emitting source including an electron emitting unit facing the target layer; and an insulating pipe that electrically insulates the target layer and the electron emitting source from each other.

16. A radiation generating device comprising:

the radiation generating tube according to claim 15; and a drive circuit electrically connected to each of the target layer and the electron emitting unit, the drive circuit outputting a tube voltage applied across the target layer and the electron emitting unit.

17. A radiographic apparatus comprising:

the radiation generating device according to claim 16;

a radiation detector that detects radiation generated by the radiation generating device; and a control unit that integrally controls the radiation generating device and the radiation detector.

18. A transmission-type X-ray target comprising:

a flat plate-shaped diamond substrate having a first surface and a second surface opposite to the first surface; and a target layer located on the first surface, wherein the flat plate-like shaped diamond substrate is configured with a cross-sectional shape such that a residual stress of the first surface is lower than a residual stress of the second surface.

19. The transmission-type X-ray target according to claim 18, wherein, in a case where a distribution of residual stress exists on each of the first surface and the second surface, the residual stress of the first surface is lower than the residual stress of the second surface if and only if a maximum residual stress of the first surface is lower than a maximum residual stress of the second surface.

20. The transmission-type X-ray target according to claim 18, wherein the diamond substrate further has a side surface, and wherein an angle between the first surface and the side surface is larger than an angle between the second surface and the side surface.

21. The transmission-type X-ray target according to claim 18, wherein the angle between the first surface and the side surface is an obtuse angle.

22. The transmission-type X-ray target according to claim 18, wherein the diamond substrate is a single-crystal diamond.

23. The transmission-type X-ray target according to claim 22, wherein the diamond substrate is made by separating a part of a base material, which is made of a single-crystal, from the base material.

24. The transmission-type X-ray target according to claim 23, wherein the diamond substrate is made by separating a part of the base material from the base material by irradiation of local heating light.

25. The transmission-type X-ray target according to claim 18, wherein a layer thickness of the target layer is in the range of 1 μm to 20 μm.

26. The transmission-type X-ray target according to claim 18, further comprising:

an electrode disposed on the diamond substrate so as to extend from a periphery of the target layer to a periphery of the diamond substrate, the periphery of the target layer being distant from the periphery of the diamond substrate.

27. The transmission-type X-ray target according to claim 26, wherein the electrode includes a metallic element having a negative standard free energy of formation of carbide.

28. The transmission-type X-ray target according to claim 27, wherein the electrode includes titanium, zirconium, or chromium.

29. The transmission-type X-ray target according to claim 26, wherein a layer thickness of the electrode is in the range of 100 nm to 10 μm.

30. A target structure comprising:

the transmission-type X-ray target according to claim 20; and an anode member that is located along at least one of the side surface and a periphery of the first surface and that is electrically connected to the target layer.

31. The target structure according to claim 30, wherein the target layer and the anode member are electrically connected to each other through a brazed joint.

32. A radiation generating tube comprising:

the transmission-type X-ray target according to claim 18;

an electron emitting source including an electron emitting unit facing the target layer; and an insulating pipe that electrically insulates the target layer and the electron emitting source from each other.

33. A radiation generating device comprising:

the radiation generating tube according to claim 32; and a drive circuit electrically connected to each of the target layer and the electron emitting unit, the drive circuit outputting a tube voltage applied across the target layer and the electron emitting unit.

34. A radiographic apparatus comprising:

the radiation generating device according to claim 33;

a radiation detector that detects radiation generated by the radiation generating device; and a control unit that integrally controls the radiation generating device and the radiation detector.

* * * * *